US005512539A

United States Patent [19]

Matsuura et al.

[11] Patent Number: 5,512,539

[45] Date of Patent: Apr. 30, 1996

[54] MICROWAVE COMPONENT OF COMPOUND OXIDE SUPERCONDUCTOR MATERIAL HAVING CRYSTAL ORIENTATION FOR REDUCING ELECTROMAGNETIC FIELD PENETRATION

[75] Inventors: Takashi Matsuura; Kenjiro Higaki; Hideo Itozaki, all of Hyogo, Japan

[73] Assignee: Sumitomo Electric Industries, Ltd., Osaka, Japan

[21] Appl. No.: 51,099

[22] Filed: Apr. 22, 1993

[30] Foreign Application Priority Data

Apr. 22, 1992 [JP] Japan ..... 4-129525

[51] Int. Cl.[6] ..... H01B 12/02; H01P 1/203; H01P 7/08

[52] U.S. Cl. ..... 505/210; 505/700; 505/701; 505/866; 333/99.S; 333/204; 333/219

[58] Field of Search ..... 333/99 S, 204, 333/219; 505/1, 700, 701, 866, 210

[56] References Cited

U.S. PATENT DOCUMENTS 4,918,049 4/1990 Cohn et al. ..... 505/701 X

FOREIGN PATENT DOCUMENTS 357507 3/1990 European Pat. Off. ..... 505/701
484254 5/1992 European Pat. Off. ..... 33/99 S
516145 12/1992 European Pat. Off. ..... 333/99 S
168401 12/1981 Japan ..... 333/204
19302 1/1985 Japan ..... 333/204

OTHER PUBLICATIONS

Wither, R. S. et al; "High–$T_c$Superconductive Thin Films for Microwave Applications"; *Solid State Technology;* Aug. 1990; pp. 83–87.

Braginski et al; "Prospects for Thin Film electronic devices of high–$T_c$ superconductors";5th Int'l FED hiTcSc Ed Workshop;2–4 Jun. 1988; pp. 171–179.

*Primary Examiner*—Benny T. Lee
*Attorney, Agent, or Firm*—Foley & Lardner

[57] ABSTRACT

A microwave component includes a superconducting signal conductor formed on a first dielectric substrate, and a superconducting ground conductor formed on a second dielectric substrate. The first dielectric substrate is stacked on the superconducting ground conductor of the second dielectric substrate. Each of the superconducting signal conductor and the superconducting ground conductor is formed of an oxide superconductor thin film of which crystals are orientated in such a manner that the c-planes of the crystals are parallel to the direction in which an electromagnetic field generated by microwave launched to the microwave component changes.

14 Claims, 5 Drawing Sheets

MICROWAVE COMPONENT OF COMPOUND OXIDE SUPERCONDUCTOR MATERIAL HAVING CRYSTAL ORIENTATION FOR REDUCING ELECTROMAGNETIC FIELD PENETRATION

BACKGROUND OF THE INVENTION

1. Field of the Invention

The present invention relates to microwave components, and particularly to a novel structure of microwave components which have a signal conductor formed of an oxide superconductor thin film.

2. Description of Related Art

Electromagnetic waves called "microwaves" or "millimetric waves" having a wavelength in a range of a few tens of centimeters to a few millimeters can be theoretically said to be merely a part of an electromagnetic wave spectrum, but in many cases, have been considered from the viewpoint of electrical engineering as being a special independent field of the electromagnetic waves, since special and unique methods and devices have been developed for handling these electromagnetic waves.

In the case of propagating an electromagnetic wave in frequency bands which are called the microwave and the millimetric wave, a twin-lead type feeder used in a relative low frequency band has an extremely large transmission loss. In addition, if an inter-conductor distance approaches a wavelength, a slight bend of the transmission line and a slight mismatch in connection portion cause reflection and radiation, and the microwave is easily affected by adjacent objects due to a electromagnetic interference. Thus, a tubular waveguide having a sectional size comparable to the wavelength has been utilized. The waveguide and a circuit constituted of the waveguide constitute a three-dimensional circuit, which is larger than components used in ordinary electric and electronic circuits. Therefore, application of the microwave circuit has been limited to special fields.

However, miniaturized devices composed of semiconductors have been developed as an active element operating in a microwave band. In addition, with advancement of integrated circuit technology, a so-called microstrip line having a extremely small inter-conductor distance has been used.

In general, the microstrip line has an attenuation coefficient that is attributable to a resistance component of the conductor. This attenuation coefficient attributable to the resistance component increases in proportion to a root of a frequency. On the other hand, the dielectric loss increases in proportion to increase of the frequency. However, the loss in a recent microstrip line is almost attributable to the resistance of the conductor in a frequency region not greater than 10 GHz, since the dielectric materials have been improved. Therefore, if the resistance of the conductor in the strip line can be reduced, it is possible to greatly elevate the performance of the microstrip line. Namely, by using a superconducting microstrip line, the loss can be significantly decreased and microwaves of higher frequency range can be transmitted.

As is well known, the microstrip line can be used as a simple signal transmission line. In addition, if a suitable patterning is applied, the microstrip line can be used as microwave components including an inductor, a filter, a resonator, a delay line, etc. Accordingly, improvement of the microstrip line will lead to improvement of characteristics of the microwave component.

In addition, the oxide superconductor material which has been recently advanced in study makes it possible to realize the superconducting state by low cost liquid nitrogen cooling. Therefore, various microwave components having a signal conductor formed of an oxide superconductor have been proposed.

However, one problem has been encountered in which a ratio of a density $n_s$ of superconducting electrons to a density $n_n$ of normal conducting electrons changes as its temperature changes, even if the temperature is lower than the critical temperature. By this, the magnetic field penetration depth $\lambda$ of the oxide superconductor changes as its temperature changes. In the case of a filter or a microwave resonator using the oxide superconductor, this change of the magnetic field penetration depth $\lambda$ of the oxide superconductor results in change of the resonating frequency $f_o$. Namely, the resonating frequency $f_o$ of the filter and the microwave resonator has a temperature dependence under the critical temperature of the oxide superconductor.

The microwave components using the oxide superconductor are chilled by liquid nitrogen during the operation, so that the change of temperature is essentially small. Therefore, it is impossible to maintain the constant temperature of the microwave components practically during the operation so as to prevent the change of the resonating frequency $f_o$.

SUMMARY OF THE INVENTION

Accordingly, it is an object of the present invention to provide microwave components which have overcome the above mentioned defect of the conventional ones.

Another object of the present invention is to provide a novel microwave resonator of which the resonating frequency has little temperature dependency.

Still another object of the present invention is to provide a novel filter of which the resonating frequency has little temperature dependency.

The above and other objects of the present invention are achieved in accordance with the present invention by a microwave component including a dielectric substrate, a patterned superconducting signal conductor provided at one surface of said dielectric substrate and a superconducting ground conductor provided at the other surface of said dielectric substrate, the superconducting signal conductor and the superconducting ground conductor are formed of an oxide superconductor thin film of which crystals are orientated in such a manner that the c-planes of the crystals are parallel to the direction in which an electro-magnetic field generated by microwave launched to the microwave component changes.

As pointed out above, the microwave component in accordance with the present invention is characterized in that it has a superconducting signal conductor and a superconducting ground conductor formed of a specific oxide superconductor thin film.

It is known that the oxide superconductor has various unique characteristics different from conventional metal superconductors. The microwave component in accordance with the present invention utilizes one of the unique characteristics of the oxide superconductor.

Namely, the oxide superconductor has an isotropic superconducting property that the magnetic field penetration depth $\lambda$ of the oxide superconductor is the shortest in the direction parallel to the c-plane of its crystal, or perpendicular to the c-axis of its crystal. Therefore, if the superconducting signal conductor and the superconducting ground conductor are formed of an oxide superconductor thin film of which crystals are orientated in such a manner that the c-planes of the crystals are parallel to the direction in which an electro-magnetic field generated by a microwave launched to the microwave component changes, the magnetic field penetrates into the superconducting signal conductor and the superconducting ground conductor for an extremely short length. Therefore, the microwave component has little temperature dependency of the resonating frequency in the temperature region not higher than the critical temperature.

In the above mentioned microwave component, a launched microwave travels along the surface of the substrate and an electromagnetic field is generated in the direction perpendicular to the surface. Therefore, the crystals of the oxide superconductor thin film are orientated in such a manner that the c-axes of the crystals are parallel to the substrate.

In one preferred embodiment, the oxide superconductor thin film is an α-axis orientated oxide superconductor thin film.

The superconducting signal conductor layer and the superconducting ground conductor layer of the microwave component in accordance with the present invention can be formed of thin films of general oxide superconductor materials such as a high critical temperature (high-Tc) copper-oxide type oxide superconductor material typified by a Y-Ba-Cu-O type compound oxide superconductor material, a Bi-Sr-Ca-Cu-O type compound oxide superconductor material, and a Tl-Ba-Ca-Cu-O type compound oxide superconductor material. In addition, deposition of the oxide superconductor thin film can be exemplified by sputtering, laser evaporation, etc.

The substrate can be formed of a material selected from the group consisting of MgO, $SrTiO_3$, $NdGaO_3$, $Y_2O_3$, $LaAlO_3$, $LaGaO_3$, $Al_2O_3$, and $ZrO_2$. However, the material for the substrate is not limited to these materials, and the substrate can be formed of any oxide material which does not diffuse into the high-Tc copper-oxide type oxide superconductor material used, and which substantially matches in crystal lattice with the high-Tc copper-oxide type oxide superconductor material used, so that a clear boundary is formed between the oxide insulator thin film and the superconducting layer of the high-Tc copper-oxide type oxide superconductor material. From this viewpoint, it is possible to use an oxide insulating material conventionally used for forming a substrate on which a high-Tc copper-oxide type oxide superconductor material is deposited.

A preferred substrate material includes a MgO single crystal, a $SrTiO_3$ single crystal, a $NdGaO_3$ single crystal substrate, a $Y_2O_3$, single crystal substrate, a $LaAlO_3$ single crystal, a $LaGaO_3$ single crystal, a $Al_2O_3$ single crystal, and a $ZrO_2$ single crystal.

For example, the oxide superconductor thin film can be deposited by using, for example, a (100) surface of a MgO single crystal substrate, a (110) surface or (100) surface of a $SrTiO_3$ single crystal substrate and a (001 ) surface of a $NdGaO_3$ single crystal substrate, as a deposition surface on which the oxide superconductor thin film is deposited.

The above and other objects, features and advantages of the present invention will be apparent from the following description of preferred embodiments of the invention with reference to the accompanying drawings However, the examples explained hereinafter are only for illustration of the present invention, and therefore, it should be understood that the present invention is in no way limited to the following examples.

DESCRIPTION OF THE PREFERRED EMBODIMENTS

Figure 1:
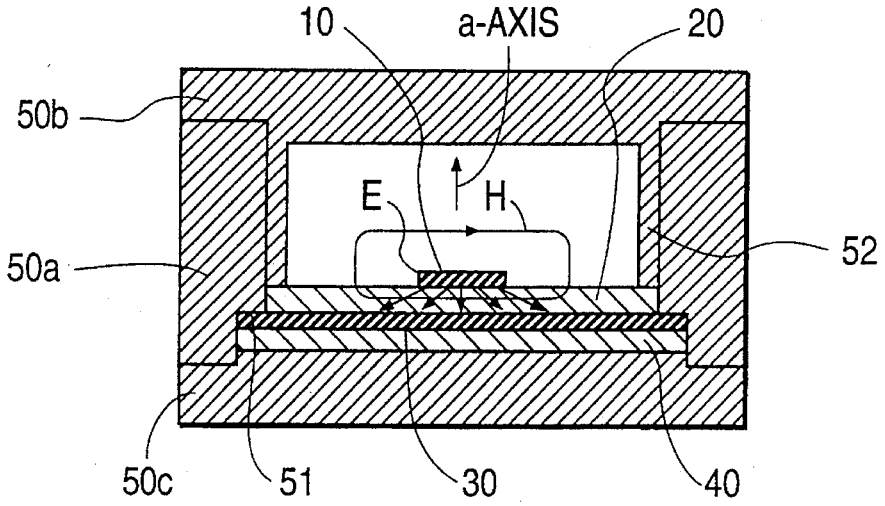
FIG. 1 is a diagrammatic sectional view showing a first embodiment of the superconducting microwave component in accordance with the present invention.

Referring to FIG. 1, them is shown a diagrammatic sectional view showing an embodiment of the microwave component in accordance with the present invention.

The shown microwave component includes a first substrate 20 formed of a dielectric material and having an upper surface formed with a superconducting signal conductor 10 constituted of an α-axis orientated oxide superconductor thin film patterned in a predetermined shape mentioned hereinafter, and a second substrate 40 formed of a dielectric material and having an upper surface fully covered with a superconducting ground conductor 30 also formed of an α-axis orientated oxide superconductor thin film. The first and second substrates 20 and 40 are stacked on each other in such a manner that an all lower surface of the first substrate 20 is in contact with the superconducting ground conductor 30. The stacked assembly of the first and second substrates 20 and 40 is located within a hollow package **50*a* of a square section having upper and lower open ends, which is encapsulated and sealed at its upper and lower ends with a top cover 50*b* and a bottom cover 50*c*, respectively. The second substrate 40 lies on an upper surface of the bottom cover 50*c***.

Since the oxide superconductor thin film 10 is formed on the first substrate 20 and the oxide superconductor thin film 30 is formed on the first substrate 40 independently of the first substrate 20, it is possible to avoid deterioration of the oxide superconductor thin films, which would occur when a pair of oxide superconductor thin films are sequentially deposited on one surface of a substrate and then on the other surface of the same substrate.

As shown in FIG. 1, the second substrate 40 is larger in size than the first substrate 20, and an inner surface of the package 50*a* has a step 51 to comply with the difference in size between the first substrate 20 and the second substrate 40. Thus, the second substrate 40 is sandwiched and fixed between the upper surface of the bottom cover 50*c* and the step 51 of the package 50*a*, in such a manner that the superconducting ground conductor 30 formed on the second substrate 40 is at its periphery in contact with the step 51 of the package 50*a*.

In addition, the top cover 50*b* has an inner wall 52 extending downward along the inner surface of the package 50*a* so as to abut against the upper surface of the first substrate 20, so that the first substrate 20 is forcibly pushed into a close contact with the the superconducting ground conductor 30 of the second substrate 40, and held between the second substrate 40 and a lower end of the inner wall 52 of the top cover 50*b*.

In addition, actually, lead conductors (not shown) are provided to penetrate through the package 50*a* or the top cover 50*b* in order to launch microwave into the signal conductor 10.

Figure 2:
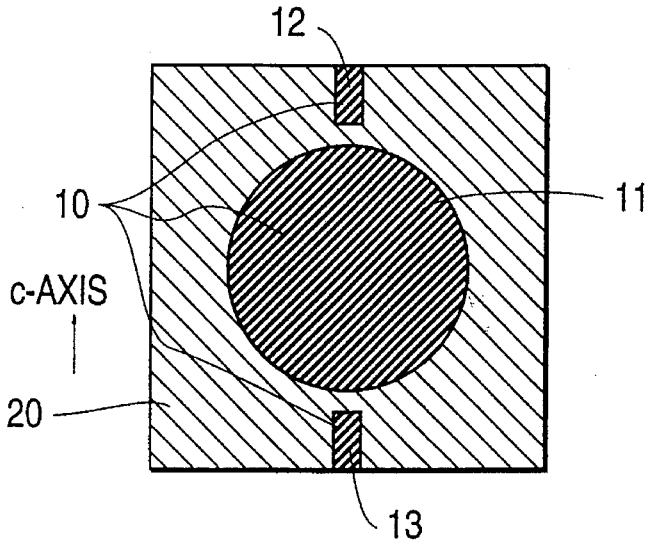
FIG. 2 is a pattern diagram showing an embodiment of the signal conductor of the superconducting microwave component shown in FIG. 1.

FIG. 2 shows a pattern of the superconducting signal conductor 10 formed on the first substrate 20 in the microwave component shown in FIG. 1. The microwave component which has the superconducting signal conductor patten shown in FIG. 2 becomes a microwave resonator.

As shown in FIG. 2, on the first substrate 20 there are formed a circular superconducting signal conductor 11 to constitute a resonator, and a pair of superconducting signal conductors 12 and 13 launching and picking up the microwave to and from the superconducting signal conductor 11. These superconducting signal conductors 11, 12 and 13 and the superconducting ground conductor 30 on the second substrate 40 can be formed of an α-axis orientated oxide superconductor thin film, for example an α-axis orientated $Y_1Ba_2Cu_3O_{7-\delta}$ compound oxide superconductor thin film.

The oxide superconductor thin film is not limited to the α-axis orientated oxide superconductor thin film but it can be constituted of oxide superconductor crystals which are orientated in such a manner that the c-axes of the oxide superconductor crystals are parallel to the surface of the substrate.

The microwave resonator having the above mentioned construction is used by cooling the superconducting signal conductor 10 and the superconductor ground conductor 30 so that the conductors 10 and 30 behave as superconductors. When a microwave is launched into the signal conductor 10, magnetic field shown in FIG. 2 by an arrow H and electric field shown by arrows E are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small.

Figure 3:
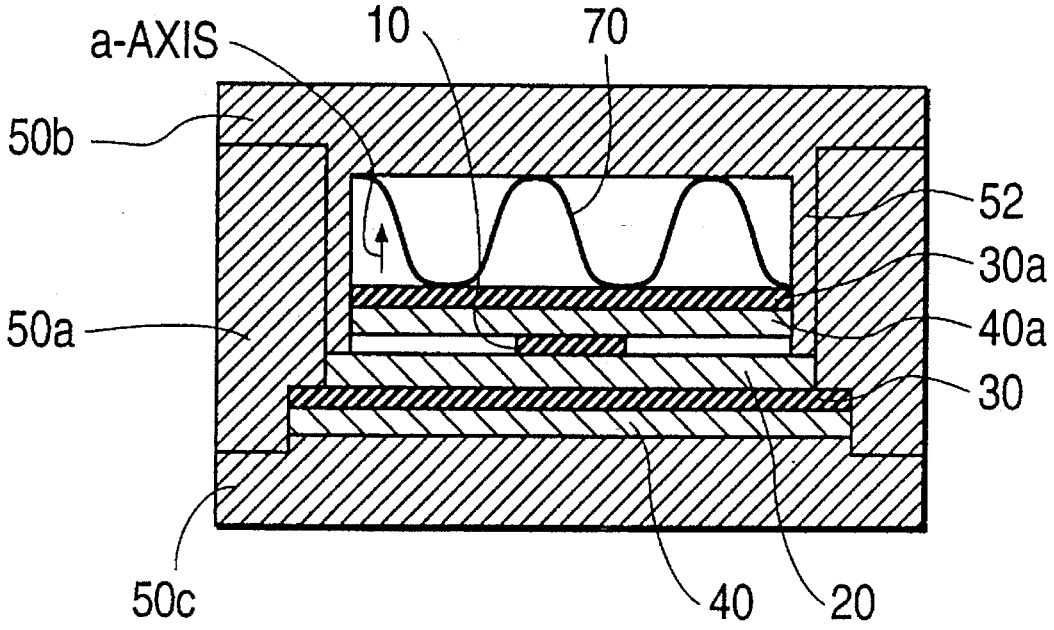
FIG. 3 is a diagrammatic sectional view showing a second embodiment of the superconducting microwave component in accordance with the present invention.

A microwave resonator having a construction shown in FIG. 3 was actually manufactured.

The microwave resonator shown in FIG. 3 has a construction basically similar to that shown in FIG. 1, but additionally includes a third substrate 40*a* formed with an α-axis orientated oxide superconductor thin film which constitutes a second superconducting ground conductor 30*a*. The third substrate 40*a* is formed of a dielectric material, and is stacked on the superconducting signal conductor 10 and is located within the package 50*a*. The third substrate 40*a* is brought into a close contact with the superconducting signal conductor 10 by means of a spring 70.

The top cover 50*b* has an inner wall 52 extending downward along the inner surface of the package 50*a* so as to abut against the upper surface of the first substrate 20. In this manner, the first substrate 20 is forcibly pushed into close contact with the superconducting ground conductor 30 of the substrate 40, and held between the second substrate 40 and a lower end of the inner wall 52 of the top cover 50*b*.

The first substrate 20 was formed of a square MgO substrate having each side of 18 mm and a thickness of 1 mm. The superconducting signal conductor 10 was formed of an α-axis orientated $Y_1Ba_2Cu_3O_{7-\delta}$ compound oxide thin film having a thickness of 500 nanometers. This $Y_1Ba_2Cu_3O_{7-\delta}$ compound oxide superconductor thin film was deposited by a sputtering. The deposition condition was as follows:

| | |
|---|---|
| Target | $Y_1Ba_2Cu_3O_{7-\delta}$ |
| Sputtering gas | Ar containing 20 mol % of $O_2$ |
| Gas pressure | 0.5 Torr |
| Substrate Temperature | 580° C. |
| Film thickness | 500 nanometers |

The complete superconducting complete signal conductor 10 thus formed was patterned as follows so as to constitute the resonator: A superconducting signal conductor 11 (FIG. 2) is in the form of a circle having a diameter of 12 mm, and the pair of superconducting signal launching conductors 12 and 13 (FIG. 2) have a width of 0.4 mm and a length of 2.0 mm. A distance or gap between the superconducting signal conductor 11 and each of the superconducting signal launching conductors 12 and 13 is 1.0 mm at a the shortest portion.

On the other hand, the second substrate 40 and the third substrate 40*a* were formed of square MgO substrates having a thickness of 1 mm. The second substrate 40 and the third substrate have each side of 20 mm and 18 mm, respectively. The superconducting ground conductors 30 and 30*a* were formed of an α-axis orientated $Y_1Ba_2Cu_3O_{7-\delta}$ compound oxide thin film having a thickness of 500 nanometers, in a sputtering similar to that for deposition of superconducting signal conductor 10.

The above mentioned three substrates 20, 40, and 40*a* were located within the square-section hollow package 50*a* formed of brass, and opposite openings of the package 50*a* were encapsulated and sealed with the covers 50*b* and 50*c* also formed of brass. In this process, the third substrate 40*a* was brought into a close contact with the superconducting signal conductor 10 by means of a spring 70.

For the superconducting microwave resonator thus formed, a frequency characteristics of the transmission power was measured by use of a network analyzer.

By locating the microwave resonator in accordance with the present invention and a conventional microwave resonator using c-axis orientated $Y_1Ba_2Cu_3O_{7-\delta}$ oxide superconductor thin film in a cryostat, resonating frequency was measured at temperatures of 77° K., 79° K., and 81° K., respectively. The result of the measurement is as follows:

| | | | |
|---|---|---|---|
| measurement temperature (K.) | 77 | 79 | 81 |
| resonating frequency (MHz) | 4446.7 | 4446.5 | 4446.4 |

-continued

| | | | |
|---|---|---|---|
| (Present invention) resonating frequency (MHz) (Reference) | 4448.1 | 4446.5 | 4444.5 |

It will be noted that the resonating frequency of the microwave resonator in accordance with the present invention changed little with the temperature.

As mentioned above, the microwave resonator in accordance with the present invention is so constructed that the resonating frequency $f_o$ negligibly changes with temperature. Therefore, the resonator has a stable performance and the adjustment is unnecessary during the operation.

Accordingly, the microwave resonator in accordance with the present invention can be effectively used in a local oscillator of microwave communication instruments, and the like.

FIGS. 4 to 9 show other pattens of the superconducting signal conductor 10 and superconducting ground conductor 30 formed on the first substrate 20 in the microwave component shown in FIG. 1. (The individual elements of the patterns are referred to collectively as superconducting signal conductors 10 and superconducting ground conductors 30 for ease of explanation and to indicate the several locations of the elements as shown in FIGS. 1 and 3.) The microwave components which have these superconducting signal conductor patterns become various filters.

Figure 4:
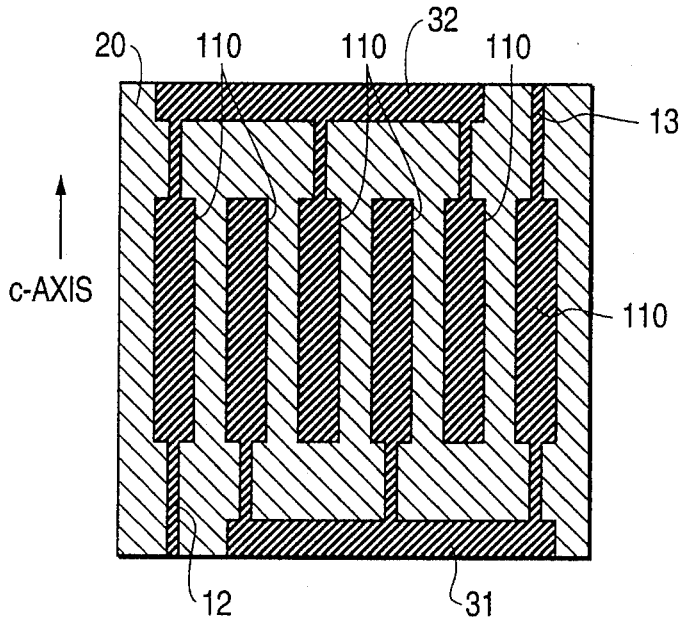
FIG. 4 is a pattern diagram of an embodiment of the signal conductor of the superconducting microwave component shown in FIG. 1.

FIG. 4 shows a pattern for a band-pass filter. As shown in FIG. 4, on the first substrate 20 there are formed of six rectangular superconducting signal conductors 110 arranged in a row at a constant interval in parallel with each other to constitute a resonator of $\lambda_g/4$, ($\lambda_g$ being the wavelength of a microwave which passes the band-pass filters) a pair of superconducting ground conductors 31 and 32 to which the every alternative signal conductor is connected, and a pair of superconducting signal conductors 12 and 13 launching and picking up the microwave to and from both ends of the superconducting signal conductors 110. These superconducting signal conductors 110, 12 and 13 and the superconducting ground conductor 31 and 32 can be formed of an α-axis orientated oxide superconductor thin film, for example an α-axis orientated $Y_1Ba_2Cu_3O_{7-\delta}$ compound oxide superconductor thin film like the superconducting signal conductors shown in FIG. 2.

The band-pass filter having the above mentioned construction is used by cooling the superconducting signal conductor 10 and the superconductor ground conductor 30 so that the conductors 10 and 30 behave as superconductors. When a microwave is launched into the signal conductor 10, magnetic field and electric field are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small, so that the band-pass filter has a stable characteristics.

Figure 5:
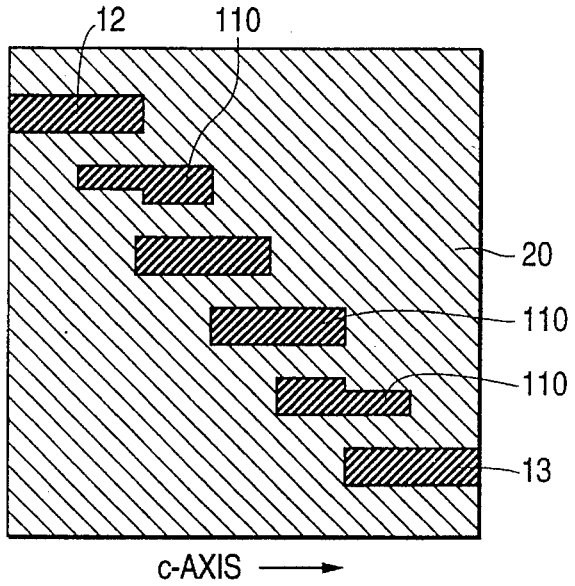
FIG. 5 is another pattern diagram of an embodiment of the signal conductor of the superconducting microwave component shown in FIG. 1.

FIG. 5 shows another pattern for a band-pass filter. As shown in FIG. 5, on the first substrate 20 there are formed two hexagonal and two rectangular superconducting signal conductors 110 having a same length arranged at a constant interval in parallel with each other overlapping their half length to constitute a resonator of $\lambda_g/2$, and a pair of superconducting signal conductors 12 and 13 launching and picking up the microwave to and from the both end superconducting signal conductors 110. These superconducting signal conductors 110, 12 and 13 can be formed of an α-axis orientated oxide superconductor thin film, for example an α-axis orientated $Y_1Ba_2Cu_3O_{7-\delta}$ compound oxide superconductor thin film like the superconducting signal conductors shown in FIG. 2.

The band-pass filter having the above mentioned construction is used by cooling the superconducting signal conductor 10 and the superconductor ground conductor 30 so that the conductors 10 and 30 behave as superconductors. When a microwave is launched into the signal conductor 10, magnetic field and electric field are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small, so that the band-pass filter has a stable characteristics.

Figure 6:
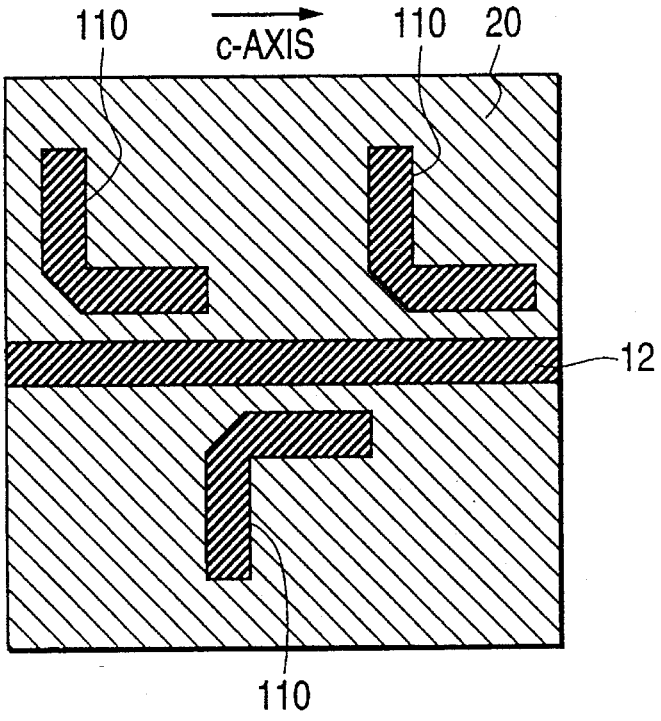
FIG. 6 is another pattern diagram of an embodiment of the signal conductor of the superconducting microwave component shown in FIG. 1.

FIG. 6 shows a pattern for a band rejection filter. As shown in FIG. 6, on the first substrate 20 there are formed a signal launching conductor 12 across the substrate 20 and three L-shaped superconducting signal conductors 110 arranged at both sides of the signal conductor 12 alternately to constitute a resonator. The superconducting signal conductors 110 have a length of $\lambda_g/2$ and are arranged at a interval of $\lambda_g/4$ ($\lambda_g$ being a wavelength of a microwave which is rejected by the band rejection filter). These superconducting signal conductors 12 and 110 can be formed of an α-axis orientated oxide superconductor thin film, for example an α-axis orientated $Y_1Ba_2Cu_3O_{7-\delta}$ compound oxide superconductor thin film like the superconducting signal conductors shown in FIG. 2.

The band rejection filter having the above mentioned construction is used by cooling the superconducting signal conductor 10 and the superconductor ground conductor 30 so that the conductors 10 and 30 behave as superconductors. When a microwave is launched into the signal conductor 10, magnetic field and electric field are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small, so that the band rejection filter has a stable characteristics.

Figure 7:
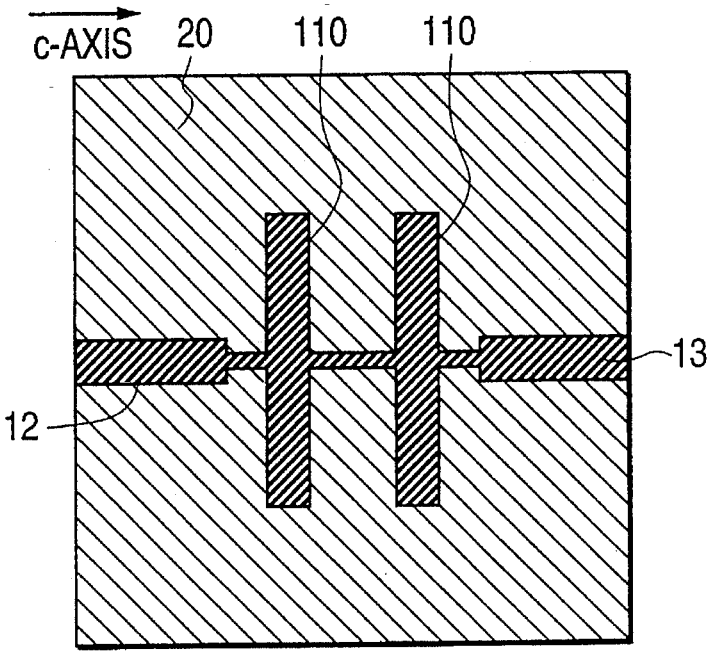
FIG. 7 is still another pattern diagram of an embodiment of the signal conductor of the superconducting microwave component shown in FIG. 1.

FIG. 7 shows a pattern for a low-pass filter. As shown in FIG. 7, on the first substrate 20 there are formed a pair of signal launching conductors 12 and 13 connected to each other across the substrate and two rectangular superconducting signal conductors 110 arranged in parallel with each other between the signal launching conductors 12 and 13 to constitute a resonator. These superconducting signal conductors 12, 13 and 110 can be formed of an α-axis orientated oxide superconductor thin film, for example an α-axis orientated $Y_1Ba_2Cu_3O_{7-\delta}$ compound oxide superconductor thin film like the superconducting signal conductors shown in FIG. 2.

The low-pass filter having the above mentioned construction is used by cooling the superconducting signal conductor 10 and the superconductor ground conductor 30 so that the conductors 10 and 30 behave as superconductors. When a microwave is launched into the signal conductor 10, magnetic field and electric field are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small, so that the low-pass filter has a stable characteristics.

Figure 8:
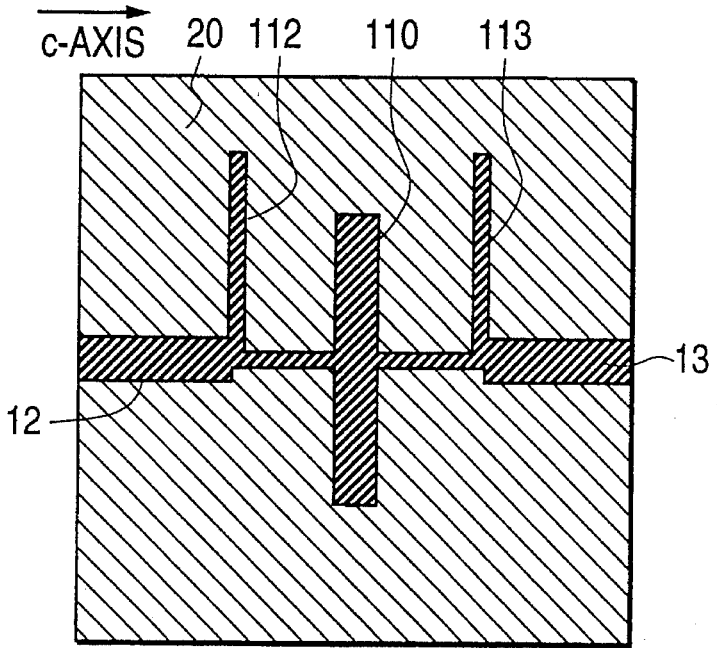
FIG. 8 is yet another pattern diagram of an embodiment of the signal conductor of the superconducting microwave component shown in FIG. 1.

FIG. 8 shows another pattern for a low-pass filter which has a rejection capability peak in the rejection band. As shown in FIG. 8, on the first substrate 20 there are formed a pair of signal launching conductors 12 and 13 connected to each other across the substrate, and one rectangular superconducting signal conductor 110 arranged between the signal launching conductors 12 and 13 and a pair of rectangular superconducting signal conductors 112 and 113 at the inner end of the signal launching conductors 12 and 13 to constitute a resonator. These superconducting signal conductors 12, 13, 110, 112 and 113 can be formed of an α-axis orientated oxide superconductor thin film, for example an α-axis orientated $Y_1Ba_2Cu_3O_{7-\delta}$ compound oxide superconductor thin film like the superconducting signal conductors shown in FIG. 2.

The low-pass filter having the above mentioned construction is used by cooling the superconducting signal conductor 10 and the superconductor ground conductor 30 so that the conductors 10 and 30 behave as superconductors. When a microwave is launched into the signal conductor 10, magnetic field and electric field are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small, so that the low-pass filter has a stable characteristics.

Figure 9:
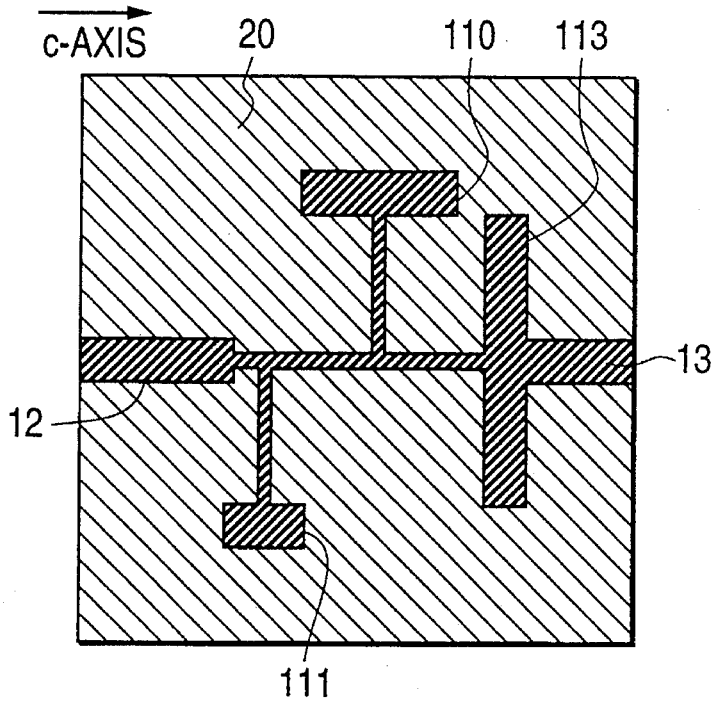
FIG. 9 is another pattern diagram of an embodiment of the signal conductor of the superconducting microwave component shown in FIG. 1.

FIG. 9 shows still another pattern for a low-pass filter which has two rejection capability peaks in the rejection band. As shown in FIG. 9, on the first substrate 20 there are formed a pair of signal launching conductors 12 and 13 connected to each other across the substrate, and two different size T-shape superconducting signal conductors 110 and 111 arranged between the signal launching conductors 12 and 13 and a rectangular superconducting signal conductor 113 at the inner end of the signal launching conductor 13 to constitute a resonator. These superconducting signal conductors 12, 13, 110, 111 and 113 can be formed of an α-axis orientated oxide superconductor thin film, for example an α-axis orientated $Y_1Ba_2Cu_3O_{7-\delta}$ compound oxide superconductor thin film like the superconducting signal conductors shown in FIG. 2.

The low-pass filter having the above mentioned construction is used by cooling the superconducting signal conductor 10 and the superconductor ground conductor 30 so that the conductors 10 and 30 behave as superconductors. When a microwave is launched into the signal conductor 10, magnetic field and electric field are generated. Since the superconducting signal conductor 10 and the superconductor ground conductor 30 are formed of an α-axis orientated oxide superconductor thin film, the magnetic field penetrates into the superconducting signal conductor 10 and the superconductor ground conductor 30 in the direction parallel to the c-plane, or perpendicular to the c-axis of the oxide superconductor crystal, so that the penetration depth becomes quite small. Therefore, the change of the resonating frequency with temperature becomes negligibly small, so that the low-pass filter has a stable characteristics.

The c-axis orientation of the oxide superconducting crystals of the invention is parallel to the substrate. Exemplary orientations of the c-axis oxide superconductor are provided in FIGS. 2 and 4–9.

The invention has thus been shown and described with reference to the specific embodiments. However, it should be noted that the present invention is in no way limited to the details of the illustrated structures but changes and modifications may be made within the scope of the appended claims.

We claim:

1. A microwave component, comprising:

a first dielectric substrate;

a patterned superconducting signal conductor provided at a first surface of said first dielectric substrate; and a superconducting ground conductor provided at a second surface of said first dielectric substrate, wherein a microwave signal applied to and launched on the superconducting signal conductor generates an electromagnetic field which penetrates into the superconducting signal conductor, and said superconducting signal conductor and said superconducting ground conductor are respectively comprised of either the same oxide superconductor film or different oxide superconductor films having corresponding crystals which are orientated in such a manner that the respective c-axis of the crystals are parallel to the first surface of the first dielectric substrate such that penetration of the electromagnetic field into the superconducting signal conductor is reduced.

2. A microwave component claimed in claim 1, wherein the crystals of the corresponding oxide superconductor thin films are orientated in such a manner that c-planes of the crystals are substantially parallel to a direction in which the electromagnetic field generated by the microwave signal penetrates into the superconducting signal conductor.

3. A microwave component claimed in claim 1, wherein each of the oxide superconductor thin films are an α-axis orientated oxide superconductor thin film.

4. A microwave component claimed in claim 1, wherein each of said superconducting signal conductor and said superconducting ground conductor is comprised of a high critical temperature copper-oxide type oxide superconductor material.

5. A microwave component claimed in claim 4, wherein each of said superconducting signal conductor and said superconducting ground conductor is comprised of a material selected from the group consisting of a Y-Ba-Cu-O type compound oxide superconductor material, a Bi-Sr-Ca-Cu-O type compound oxide superconductor material, and a Tl-Ba-Ca-Cu-O type compound oxide super conductor material.

6. A microwave component claimed in claim 1, wherein said dielectric substrate is comprised of a material selected from the group consisting of MgO, $SrTiO_3$, $NdGaO_3$, $Y_2O_3$, $LaAlO_3$, $LaGaO_3$, $Al_2O_3$, and $ZrO_2$.

7. A microwave component claimed in claim 1, wherein said microwave component further comprises a second dielectric substrate under said first dielectric substrate, and said superconducting signal conductor is disposed on an upper surface of said first dielectric substrate, and said superconducting ground conductor is positioned between an upper surface of said second dielectric substrate and said second surface of the first dielectric substrate so that said superconducting ground conductor is disposed on said second surface of the first dielectric substrate.

8. A microwave component claimed in claim 7, further comprising:

a package including a hollow member having a top opening and a bottom opening;

a top cover fitted to said top opening of said hollow member;

a bottom cover fitted to said bottom opening of said hollow member; and a stacked assembly comprised of said first dielectric substrate and said second dielectric substrate being located within said package in such a manner that a lower surface of said second dielectric substrate is in contact with an inner surface of said bottom cover.

9. A microwave component claimed in claim 8, further comprising:

a second superconducting ground conductor disposed so as to cover an entire upper surface of a third dielectric substrate, said third dielectric substrate having a lower surface which is in contact with said superconducting signal conductor provided on said first dielectric substrate; and a spring located between said top cover and said third dielectric substrate so as to engage said third dielectric substrate into contact with said first dielectric substrate.

10. A microwave component claimed in claim 1, wherein the superconducting signal conductor has a pattern such that the microwave component is a microwave resonator.

11. A microwave component claimed in claim 1, wherein the superconducting signal conductor has a pattern such that the microwave component is a band-pass filter.

12. A microwave component claimed in claim 1, wherein the superconducting signal conductor has a pattern such that the microwave component is a band rejection filter.

13. A microwave component claimed in claim 1, wherein the superconducting signal conductor has a pattern such that the microwave component is a low-pass filter.

14. A microwave component, comprising:

a substrate;

a patterned superconducting signal conductor comprised of an oxide superconducting thin film provided at a first surface of the substrate; and a superconducting ground conductor comprised of either the same oxide superconductor film or different oxide superconductor films provided at a second surface of the substrate, wherein a microwave signal applied to and launched on the superconducting signal conductor generates an electromagnetic field which penetrates into the superconducting signal conductor, and the superconducting signal conductor and the superconducting ground plane having respective crystal orientations which are arranged to reduce the penetration of the electromagnetic field into the superconducting signal conductor such that a resonant frequency of the microwave component at a temperature below the critical temperature is substantially independent of temperature deviations.

* * * * *